US010240346B2

(12) United States Patent
Walker

(10) Patent No.: US 10,240,346 B2
(45) Date of Patent: Mar. 26, 2019

(54) GROOVED RAILING SYSTEM

(75) Inventor: Simon Walker, Richmond (CA)

(73) Assignee: Peak Innovations Inc., Richmond (CA)

( * ) Notice: Subject to any disclaimer, the term of this patent is extended or adjusted under 35 U.S.C. 154(b) by 0 days.

(21) Appl. No.: 13/019,004

(22) Filed: Feb. 1, 2011

(65) Prior Publication Data

US 2011/0121249 A1 May 26, 2011

Related U.S. Application Data

(63) Continuation of application No. 12/537,208, filed on Aug. 6, 2009, now abandoned, which is a continuation of application No. 10/547,183, filed as application No. PCT/CA2004/000378 on Mar. 11, 2004, now abandoned.

(30) Foreign Application Priority Data

Mar. 12, 2003 (CA) ..... 2422750

(51) Int. Cl.
*E04F 11/18* (2006.01)

(52) U.S. Cl.
CPC ..... *E04F 11/1842* (2013.01); *E04F 11/181* (2013.01); *Y10T 403/1666* (2015.01)

(58) Field of Classification Search
CPC . E04F 11/181; E04F 11/1842; E04F 11/1834; E04F 11/1817; E04F 11/18
USPC ..... 256/22, 59, 66, 65.04–65.06
See application file for complete search history.

(56) References Cited

U.S. PATENT DOCUMENTS

| | | | | |
|---|---|---|---|---|
| 505,781 | A * | 9/1893 | Vance | E04F 11/181 256/21 |
| 1,090,171 | A | 3/1914 | Schisler | |
| 2,097,600 | A | 11/1937 | Pavlecka | |
| 2,277,587 | A | 3/1942 | Gustafson | |
| 2,756,999 | A | 7/1956 | Orsatti | |
| 3,083,951 | A * | 4/1963 | Huret | 256/65.08 |
| 3,166,299 | A | 1/1965 | De Chellis | |
| 3,267,627 | A | 8/1966 | Hammitt | |

(Continued)

FOREIGN PATENT DOCUMENTS

| | | |
|---|---|---|
| CA | 1041337 | 10/1978 |
| CA | 1055289 | 5/1979 |

(Continued)

*Primary Examiner* — Joshua T Kennedy
(74) *Attorney, Agent, or Firm* — Todd A. Rattray; Oyen Wiggs Green & Mutala LLP

(57) ABSTRACT

A railing system includes spacers for spacing apart railing pickets, and a rail which engages the spacers and secures the railing pickets. The spacers are made up of a planar top member, side members extending from longitudinal edges of the top member, and wings extending outwardly from a central position of the side members. The rail comprises a substantially elongated planar member and first and second substantially parallel elongated side-walls perpendicularly connected to the planar member. The side-walls each comprise first and second groove members, which are spaced apart to form grooves running substantially parallel to the elongated planar member. The grooves are adapted to receive the plurality of spacers such that the wings of the spacers abut against the first and second groove members when the spacers are assembled in the railing system.

18 Claims, 5 Drawing Sheets

(56) References Cited

U.S. PATENT DOCUMENTS

| | | | | | |
|---|---|---|---|---|---|
| 3,342,457 | A * | 9/1967 | Bobrowski | E04F 11/181 | 256/21 |
| 3,415,475 | A | 12/1968 | Goodman | | |
| 3,420,504 | A | 1/1969 | Mulitz | | |
| 3,463,456 | A | 8/1969 | Walker | | |
| 3,482,819 | A * | 12/1969 | Leurent | 256/59 | |
| 3,484,081 | A | 12/1969 | Rowan | | |
| 3,491,984 | A * | 1/1970 | Nyberg | 256/21 | |
| 3,633,862 | A | 1/1972 | Breen | | |
| 3,648,982 | A * | 3/1972 | Sabel et al. | 256/65.05 | |
| 3,875,699 | A | 4/1975 | Lamarre | | |
| 3,918,686 | A | 11/1975 | Knott et al. | | |
| 3,924,834 | A | 12/1975 | Young | | |
| 3,955,800 | A | 5/1976 | Russo | | |
| 3,957,250 | A | 5/1976 | Murphy | | |
| 4,038,802 | A | 8/1977 | Bajorek et al. | | |
| 4,050,828 | A * | 9/1977 | Noro | 403/201 | |
| 4,269,534 | A | 5/1981 | Ryan | | |
| 4,346,872 | A * | 8/1982 | Tornya | 256/65.02 | |
| 4,381,160 | A | 4/1983 | Grimm et al. | | |
| 4,429,497 | A | 2/1984 | Dibernardi | | |
| 4,586,697 | A * | 5/1986 | Tornya | 256/65.11 | |
| 4,596,489 | A | 6/1986 | Mariol et al. | | |
| 4,809,955 | A * | 3/1989 | Veilleux | 256/65.02 | |
| 4,923,164 | A | 5/1990 | Stenberg | | |
| 5,026,028 | A * | 6/1991 | Ooi et al. | 256/67 | |
| 5,200,240 | A * | 4/1993 | Baker | 428/34.1 | |
| D348,738 | S | 7/1994 | Jasinsky | | |
| 5,375,384 | A | 12/1994 | Wolfson | | |
| 5,547,169 | A * | 8/1996 | Russell | 256/67 | |
| 5,568,909 | A | 10/1996 | Timko | | |
| 5,649,688 | A * | 7/1997 | Baker | 256/21 | |
| 5,713,171 | A | 2/1998 | Andres | | |
| 5,852,895 | A | 12/1998 | Sinanan | | |
| 5,873,671 | A * | 2/1999 | West | 403/232.1 | |
| 6,003,826 | A | 12/1999 | Galloway, III | | |
| 6,017,019 | A * | 1/2000 | Erwin | 256/65.05 | |
| 6,053,481 | A * | 4/2000 | Scheide | 256/65.06 | |
| 6,061,991 | A | 5/2000 | Dahl | | |
| 6,141,928 | A | 11/2000 | Platt | | |
| 6,182,394 | B1 | 2/2001 | Bassler | | |
| 6,213,452 | B1 | 4/2001 | Pettit et al. | | |
| D443,937 | S | 6/2001 | Prokop | | |
| 6,258,465 | B1 | 7/2001 | Oka et al. | | |
| 6,282,861 | B1 | 9/2001 | Natelli, Jr. | | |
| 6,290,213 | B1 * | 9/2001 | Laird | E04F 11/181 | 256/65.05 |
| 6,308,937 | B1 * | 10/2001 | Pettit | E04F 11/181 | 256/65.05 |
| 6,336,620 | B1 | 1/2002 | Belli | | |
| 6,446,930 | B1 | 9/2002 | Li | | |
| 6,460,829 | B1 * | 10/2002 | Forbis et al. | 256/67 | |
| 6,467,756 | B1 | 10/2002 | Elsasser | | |
| 6,568,145 | B2 | 5/2003 | Bartel | | |
| 6,640,517 | B2 | 11/2003 | Mitchell | | |
| 6,702,259 | B2 | 3/2004 | Pratt | | |
| 6,712,330 | B1 | 3/2004 | Damiano | | |
| 6,718,710 | B2 | 4/2004 | Platt | | |
| 6,735,916 | B2 | 5/2004 | Peshkam et al. | | |
| 6,742,748 | B1 | 6/2004 | Gretz | | |
| 6,811,146 | B1 * | 11/2004 | Giralt | 256/65.01 | |
| 6,863,253 | B2 | 3/2005 | Valentz et al. | | |
| D503,813 | S | 4/2005 | Steffes et al. | | |
| 6,988,700 | B2 | 1/2006 | Cote | | |
| 7,155,867 | B2 | 1/2007 | Saldarelli et al. | | |
| 7,168,689 | B2 * | 1/2007 | Giralt | 256/59 | |
| 7,188,821 | B2 | 3/2007 | Curtis | | |
| 7,455,282 | B2 | 11/2008 | Platt | | |
| 2002/0040956 | A1 | 4/2002 | Carnahan et al. | | |
| 2003/0193049 | A1 * | 10/2003 | Kim | 256/67 | |
| 2003/0196395 | A1 * | 10/2003 | Forbis et al. | 52/300 | |
| 2003/0234391 | A1 | 12/2003 | Sheppard et al. | | |
| 2004/0036064 | A1 * | 2/2004 | Takagi et al. | 256/65.02 | |
| 2005/0051761 | A1 * | 3/2005 | Caissie et al. | 256/59 | |
| 2005/0051762 | A1 * | 3/2005 | Giralt | 256/59 | |
| 2006/0059812 | A1 | 3/2006 | Simmons | | |
| 2007/0187564 | A1 | 8/2007 | McGuire | | |
| 2007/0209316 | A1 * | 9/2007 | Walker | 52/736.1 | |
| 2008/0222973 | A1 | 9/2008 | Lee et al. | | |
| 2017/0089094 | A1 * | 3/2017 | Zhu | E04H 17/1421 | |

FOREIGN PATENT DOCUMENTS

| | | | |
|---|---|---|---|
| CA | 1146393 | | 5/1983 |
| CA | 1178096 | | 11/1984 |
| CA | 1223472 | | 6/1987 |
| CA | 2274263 | A1 | 6/2000 |
| CA | 2277587 | | 7/2000 |
| CA | 2387296 | | 11/2002 |
| CA | 2218466 | A1 | 7/2006 |
| CA | 2422750 | | 1/2011 |
| DE | 29607423 | | 6/1996 |
| EP | 0984118 | A2 | 3/2000 |
| GB | 1461802 | | 1/1977 |
| NZ | 242387 | | 5/1994 |
| WO | 91/13222 | | 9/1991 |
| WO | 2003000022 | A2 | 1/2003 |
| WO | 2004081314 | | 9/2004 |
| WO | 2004090264 | A1 | 10/2004 |

* cited by examiner

GROOVED RAILING SYSTEM

CROSS REFERENCE TO RELATED APPLICATIONS

This application is a continuation of U.S. Application Ser. No. 12/537,208 filed on 6 Aug. 2009 entitled RAILING SYSTEM, which is a continuation of U.S. application Ser. No. 10/547,183 filed on 11 Mar. 2004 entitled RAIL AND RAILING SYSTEM, which is US national stage of PCT International Application No. PCT/CA2004/000378 which has an international filing date of 11 Mar. 2004 and entitled RAIL AND RAILING SYSTEM, which claims the benefit of the filing date of Canadian Application No. 2,422,750 filed on 12 Mar. 2003 and entitled RAIL AND RAIL SYSTEM. The content of the applications referred to in this paragraph is incorporated herein by reference.

FIELD OF THE INVENTION

The invention relates to the field of railings and in particular to an aluminum rail and railing system.

BACKGROUND OF THE INVENTION

Railing systems for any number of outdoor applications are well known. For example, residential decks, pool decks, playgrounds, etc., all utilize any number of conventional railing systems. Such railing systems are typically made of pressure treated lumber or aluminum particularly suited for outdoor use.

Typically, aluminum railing systems utilize spacers which snap onto top and bottom rails to space out railing pickets. Although such systems adequately space out the pickets, the overall appearance of the system is less than desired given that the spacers necessarily protrude away from the railings. Furthermore, as the spacers merely snap onto the top and bottom rails, the spacers are susceptible to removal after the railing system has been assembled. Consequently, thieves may easily remove the spacers leaving the railing system vulnerable to failure. These systems are undesirable, particularly in the residential railing industry wherein homeowners frequently install or build their own rail systems.

Accordingly, a need exists for an improved rail and railing system which provides an aesthetically pleasing result and which overcomes the deficiencies noted above.

SUMMARY OF THE INVENTION

According to one aspect of the present invention there is provided a rail for a picket railing system having a plurality of spacers for spacing a plurality of railing pickets. The rail may include a substantially elongated planar member and first and second substantially parallel elongated side-walls perpendicularly connected to the planar member. The side walls may each comprise opposing grooves running substantially parallel to the elongated planar member. The grooves may be adapted to receive the plurality of spacers and may be formed within each of the side walls.

Each of the grooves may comprise a first elongated groove member and a second elongated groove member. The first elongated groove member may be connected adjacent an end of the side wall and extend perpendicularly from the side-wall. The second elongated groove member may be connected adjacent the end of said side wall and run parallel to the first groove member. The second elongated groove member may be spaced away from the first elongated groove member to permit snug insertion of the plurality of spacers between the first and second groove members.

According to another aspect of the invention there is provided a rail system for holding picket railings. The rail system may include a plurality of spacers adapted to space the picket railings apart and a rail adapted to internally receive the plurality of spacers and to secure the picket railings.

Each of the plurality of spacers may include a top member and first and second parallel wings connected to the top member. The first and second wings may be shaped to be received in grooves located within the railings.

According to yet another aspect of the invention there is provided a rail system which includes a top rail and bottom rail, a post adapted to receive the top and bottom rails, a plurality of pickets for placement between the top and bottom rails, and a plurality of spacers adapted to be inserted into the top and bottom rails for spacing the plurality of pickets apart.

The post may include an open ended head to receive the top rail and an opening for receiving the bottom rail. Alternatively, the post may include connectors to receive the top and bottom rails. The connectors may include universal angle brackets. The post may also include post supports.

Other aspects of the invention will be appreciated by reference to the detailed description of the preferred embodiment and to the claims that follow.

BRIEF DESCRIPTION OF THE DRAWINGS

Embodiments of the invention will be described by reference to the accompanying drawings.

DETAILED DESCRIPTION

Figure 1:
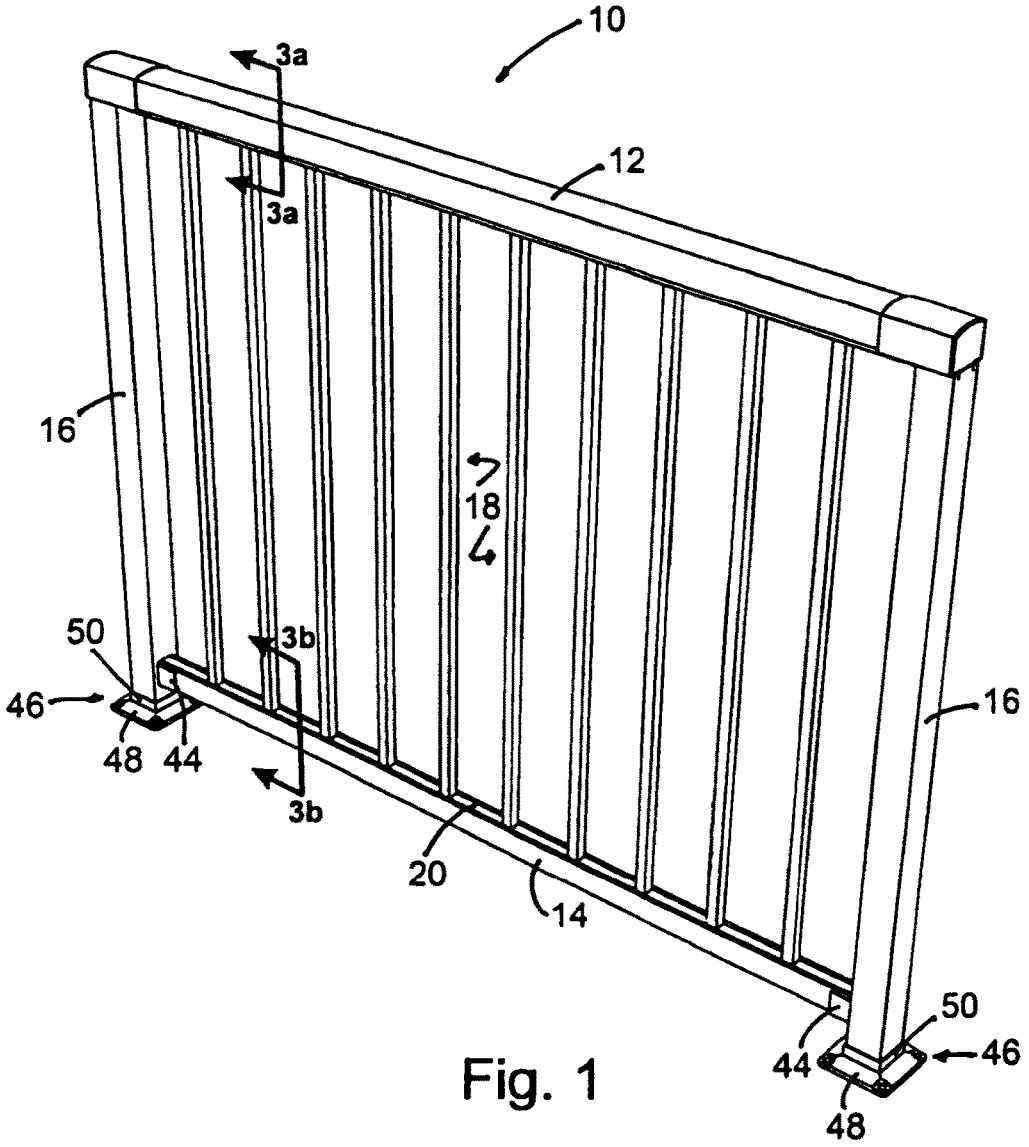
FIG. 1 is a perspective view of a rail and railing system made in accordance with a first embodiment of the present invention.
Figures 2A, 2B:
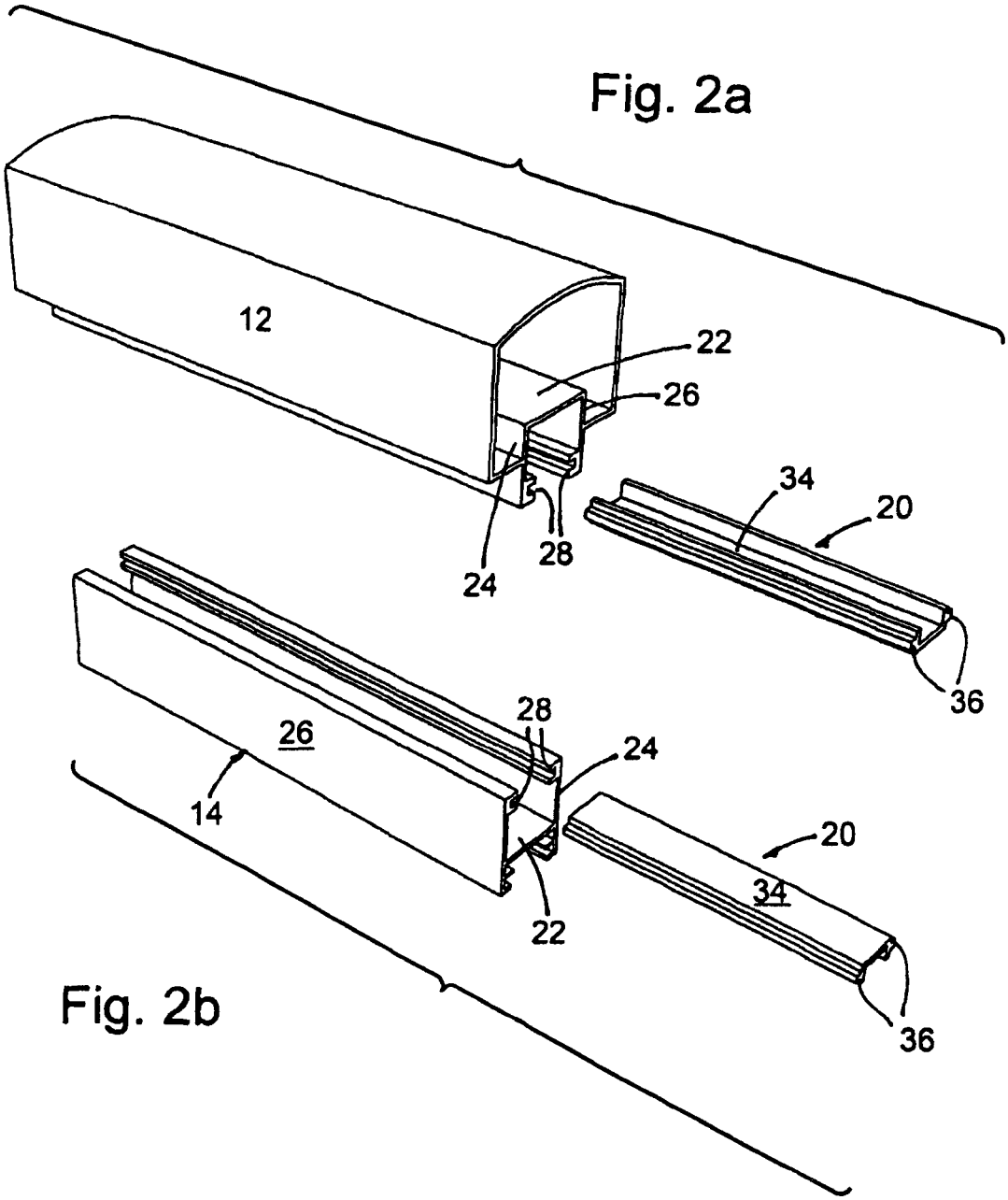
FIG. 2*a* is a perspective view of a section of top rail of FIG. 1.
FIG. 2*b* is a perspective view of a section of bottom rail of FIG. 1.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

An outdoor railing system, generally 10, according to the invention is illustrated in FIG. 1. Railing system 10 is illustrated as a section of a complete rail for purposes of illustration. The present invention includes such sections as well as a complete railing system constructed in accordance with the invention. The present invention also includes top and bottom rails 12 and 14 separately for use in such railing systems.

Conventional outdoor railing systems are typically made from aluminum. The present invention includes rails and railing systems made of aluminum, but is not limited to any particular material. For example, the components of the railing system 10 or rails 12 and 14 may be fabricated from any conventional construction material, including plastic, wood, cementious materials, and the like. Any and all such materials suitable for railing systems are within the scope and spirit of the invention.

Referring again to FIG. 1, railing system 10 includes top and bottom rails 12 and 14, posts 16, pickets 18 and picket spacers 20 in between adjacent pickets. The pickets 18 are of sufficient length to span the distance between the top and bottom rails 12 and 14.

Referring to FIGS. 2*a*, 2*b*, 3*a* and 3*b*, each rail includes a substantially elongated planar member 22 and first and second substantially parallel elongated side walls 24 and 26 perpendicularly connected to the planar member 22. The side walls 24 and 26 each include opposing grooves 28 running substantially parallel to the elongated planar member 22.

The grooves 28 are adapted to receive the spacers 20 and include a first elongated groove member 30 and a second elongated groove member 32. The first elongated groove member 30 is connected adjacent an end of the side walls 24 and 26 and extends perpendicularly from the side-walls 24 and 26. The second elongated groove member 32 is also connected adjacent the same end of the side walls 24 and 26 and runs parallel to the first groove member 30. The second elongated groove member 32 should be spaced away from the first elongated groove member 30 to permit snug insertion of the spacers 20 between the first and second groove members 30 and 32.

The first and second side walls 24 and 26 may be connected to the planar member 22 via spot welding in the case of aluminum. Similarly, the first and second groove members 30 and 32 may be connected to the side walls 24 and 26 via spot welding in the case of aluminum. As those skilled in the art will appreciate other methods of connecting the first and second side walls 24 and 26 to the planar member 22 and the groove members 30 and 32 to the side walls 24 and 26 are contemplated, for example, adhesive, fasteners etc. Preferably, each of the top and bottom rails 12 and 14 is a unitary structure which may be accomplished via an aluminum extrusion for instance or by other means known in the art.

The spacers may include a top member 34 and first and second parallel wings 36 shaped to be received in the grooves 28. The first and second parallel wings 36 may be connected to the top member 34 via spot welding in the case of aluminum. As those skilled in the art will appreciate other methods of connecting the first and second wings 36 to the top member 34 are contemplated, for example, adhesive, fasteners etc. Preferably, the first and second parallel wings 36 are integrally formed with the top member 34 via an aluminum extrusion for instance or by other means known in the art.

Figure 3A:
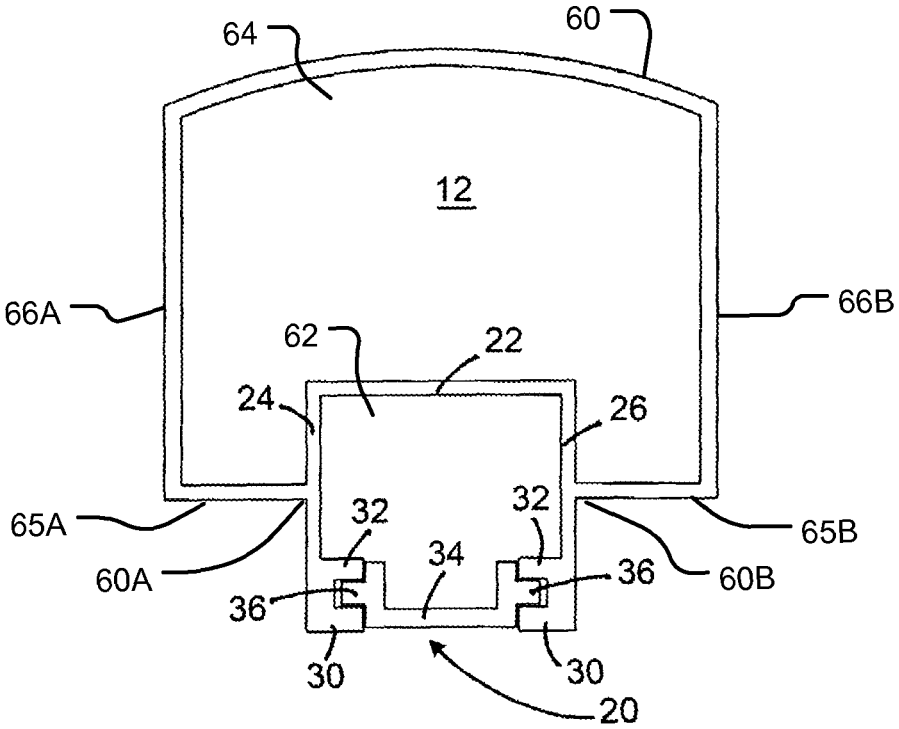
FIG. 3*a* is a cross-sectional view along line 3*a*-3*a* of FIG. 1.
Figure 3B:
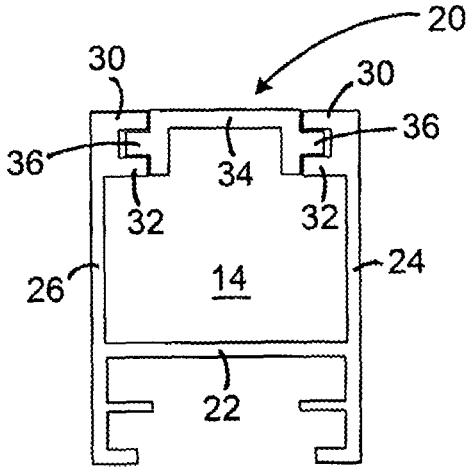
FIG. 3*b* is a cross-sectional view along line 3*b*-3*b* of FIG. 1.

As best shown in FIGS. 3*a* and 3*b*, once spacers 20 are inserted into top and bottom rails 12 and 14, the first and second parallel wings 36 abut the first and second groove members 30 and 32. In so doing, the spacers 20 snugly fit into grooves 28, thus preventing the spacers 20 from being removed from the railing system 10 after assembly. To provide for an aesthetically pleasing result, the top member 34 may be spaced away from the first and second parallel wings 36 so that the top member 34 lies flush with the first elongated groove member 30. However, in another embodiment, those skilled in the art will also appreciate that parallel wings 36 may be flush with top member 34 providing an overall flat surface.

FIG. 3*a* also shows that top rail 12 comprises a handgrip portion 60. Handgrip portion 60 has first and second edges 60A and 60B that respectively join to first and second side walls 24 and 26. FIG. 3*a* also shows that side walls 24 and 26 and planar member 22 form an elongated, downwardly opening channel 62. Downwardly opening channel 62 is dimensioned to receive the top ends of pickets 18 (not shown in FIG. 3*a*) which may project into channel 62 during assembly of railing system 10 (see FIG. 6).

As illustrated, channel 62 is generally square in cross-section. In the illustrated embodiment, handgrip portion 60 connects to the components which define channel 62 (i.e. first and second side walls 24, 26 and planar member 22) to define an elongated bore 64. Bore 64 may be defined by an exterior surface of channel 62 and an interior surface of handgrip portion 60. In the illustrated embodiment, bore 64 has the shape of an inverted U in cross-section.

In the illustrated embodiment, handgrip portion 60 comprises generally planar elongated sections 65A and 65B that are respectively adjacent to first and second edges 60A and 60B of handgrip portion 60. Sections 65A, 65B define a portion of bore 64. Sections 65A, 65B extend generally perpendicularly to side walls 24, 26 respectively. In the illustrated embodiment, lower edges of side walls 24 and 26 project downwardly past edges 60A and 60B of handgrip portion 60 and upper edges of side walls 24, 26 project upwardly past edge 60A, 60B of handgrip portion 60—i.e. edges 60A, 60B of handgrip portion 60 are connected to side walls 24, 26 in locations spaced apart from the upper and lower edges of side walls 24, 26. In the illustrated embodiment, edges 60A, 60B join to side walls 24, 26 substantially along longitudinal mid-lines of side walls 24, 26.

In the illustrated embodiment, handgrip portion 60 has opposed generally planar faces 66A and 66B that extend along the length of handgrip portion 60 and a top section 68 which extends laterally between faces 66A, 66B. Faces 66A, 66B and top section 68 define a portion of bore 64.

Figure 4:
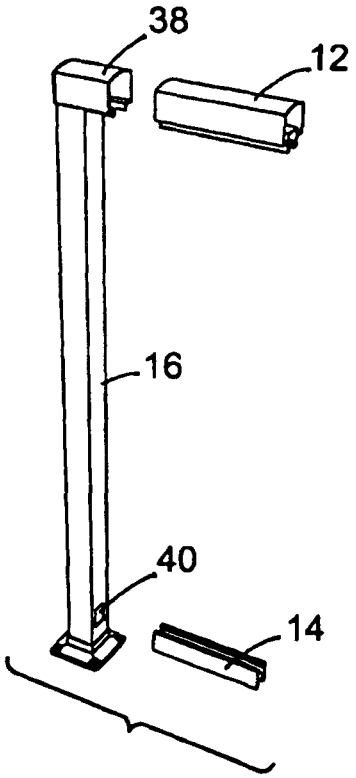
FIG. 4 is a perspective view of a post and a section of top and bottom rails of FIG. 1.

Referring to FIG. 4, the post 16 includes an open ended head 38 shaped to receive the top rail 12. In this embodiment, the post 16 may also include an opening 40 to receive the bottom rail 14. Preferably, the open ended head 38 and opening 40 are shaped to snugly fit top and bottom rails 12 and 14 to secure the top and bottom rails to the post 16. As those skilled in the art will appreciate, other methods may be used to further secure the top and bottom rails 12 and 14 to the post 16, such as fasteners.

Figure 5:
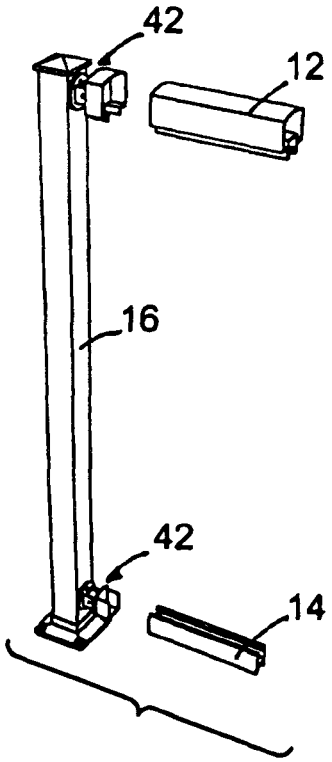
FIG. 5. is a perspective view of an alternative embodiment of the post of FIG. 4.
Figure 6:
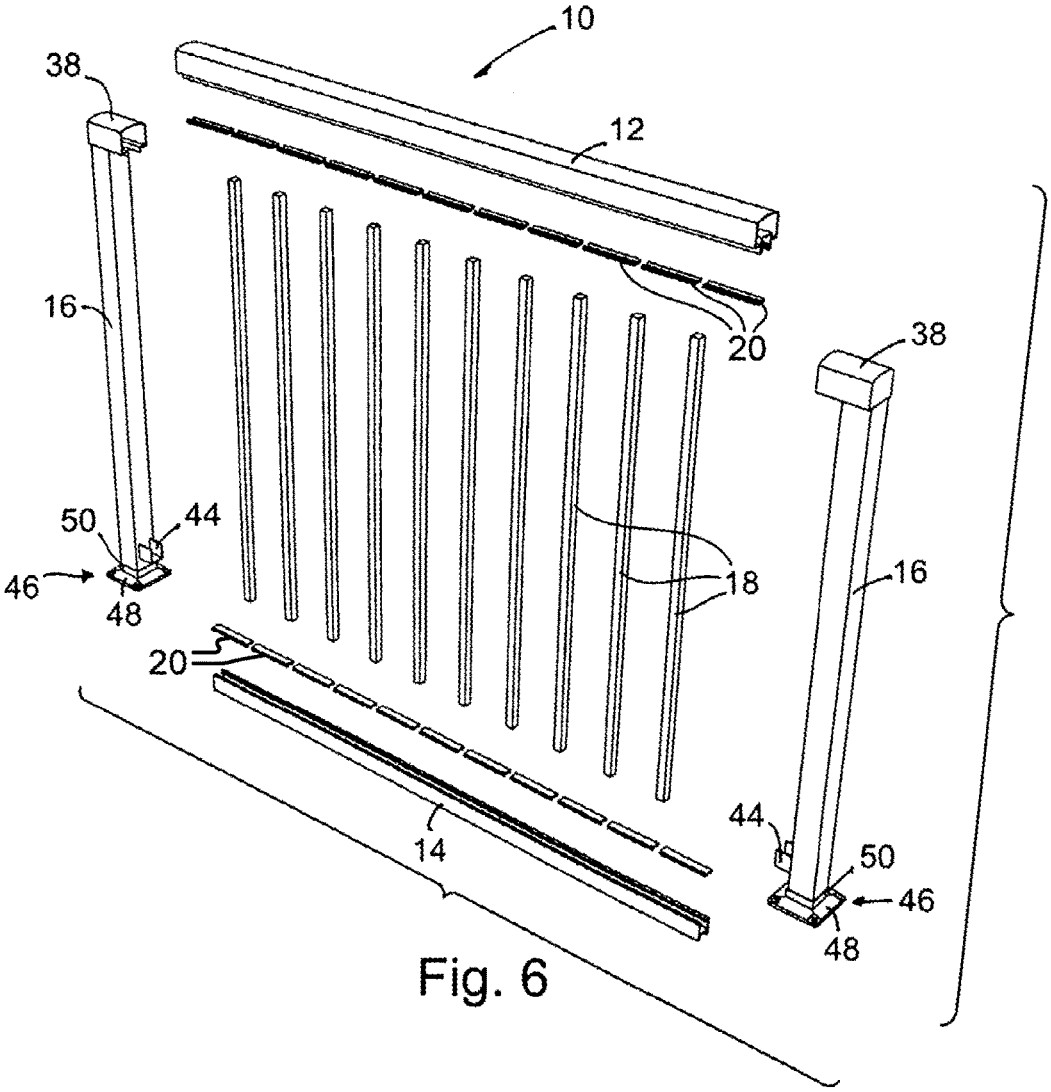
FIG. 6. is a perspective exploded view of the railing system of FIG. 1.

Referring to FIG. 5, in another embodiment, the post 16 includes connectors to receive the top and bottom rails 12 and 14. The connectors comprise universal angle brackets 42 as known to those skilled in the art. Universal angle brackets are particularly useful for railing applications requiring non-conventional angles, such as following a flight of steps. Alternatively, the connectors may simply be a U-bracket 44 as illustrated in FIGS. 1 and 6. As those skilled in the art will appreciate, several connectors are contemplated and may be used in different combinations for use with the top and bottom rails 12 and 14 without departing from the scope and spirit of the present invention.

As best illustrated in FIGS. 1 and 6, to provide additional support to the posts 16, the posts may include post supports 46. Preferably, the post supports 46 include a base 48 which can be connected to a deck surface for instance. A sleeve 50 may be attached to the base 48 to snugly receive the posts 16. The post supports 46 may be separately fabricated and attached to the posts 16 during installation of the railing system or may be integrally fabricated with the posts.

Operation

The top and bottom rails 12 and 14 are connected to a post 16. At least one spacer 20 is inserted into each of the top and bottom rails 12 and 14. A picket 18 may then be installed between the top and bottom rails 12 and 14 by simply placing the ends of the picket into the top and bottom rails and abutting the picket next to the spacers 20. Further spacers 20 and pickets 18 may be inserted until a desired number of pickets has been installed. A second post 16 may then be connected to the top and bottom rails 12 and 14 to complete the assembly resulting in an aesthetically pleasing and secure railing system. Alternatively, the top and bottom rails 12 and 14 may first be attached to a wall without the need for a first post 16 and then assembled as discussed above.

It should be appreciated by those skilled in the art that various modifications and variations can be made in the present invention without departing from the scope or spirit of the invention. It is intended that the present invention include such modifications and variations as come within the scope of the appended claims and their equivalents.

What is claimed is:

1. A railing system, the railing system comprising:

a top rail comprising:

a first elongated channel defined at least in part by substantially parallel, longitudinally extending first and second sidewalls, the first and second sidewalls connected by a longitudinally extending substantially flat channel base;

an elongated handgrip portion extending longitudinally along the channel, the handgrip portion comprising:

a first longitudinally extending edge joined to the first sidewall and a second longitudinally extending edge joined to the second sidewall;

first and second generally planar, longitudinally extending sections adjacent respectively to the first and second edges of the handgrip portion, the first and second sections respectively extending substantially perpendicularly to the first and second sidewalls of the first elongated channel;

opposed first and second generally planar faces extending longitudinally along a length of the handgrip portion, substantially parallel to the first and second sidewalls, spaced outwardly from the first and second sidewalls respectively, and extending upwardly from outward ends of the first and second sections respectively;

wherein the first and second planar faces extend vertically beyond the channel base; and longitudinally extending first and second grooves located respectively on a first face of the first sidewall and a second face of the second sidewall, the first and second faces of the first and second sidewalls each facing inwardly into the first elongated channel and the first and second grooves each opening inwardly into the first elongated channel;

wherein the first and second grooves are each defined between a lower surface of an upper groove member and an upper surface of a lower groove member, the lower surface of the upper groove member upwardly spaced apart from, and parallel to, the upper surface of the lower groove member, the groove members of the first groove extending longitudinally along the first sidewall and projecting inwardly into the first elongated channel from the first face of the first sidewall and the groove members of the second groove extending longitudinally along the second sidewall and projecting inwardly into the first elongated channel from the second face of the second sidewall;

wherein the first longitudinally extending edge of the handgrip portion joins the first sidewall along a longitudinally extending location that is upwardly spaced apart from the first groove and the second longitudinally extending edge of the handgrip portion joins the second sidewall along a longitudinally extending location that is upwardly spaced apart from the second groove;

a plurality of pickets having upper ends dimensioned for insertion into the first elongated channel between the first and second sidewalls; and one or more longitudinally extending spacers, each spacer comprising a first longitudinally extending wing extending in a first outward direction from a first longitudinally extending spacer sidewall for projection into, and extension along, the first inwardly opening groove and a second longitudinally extending wing extending in a second outward direction opposed to the first outward direction from a second longitudinally extending spacer sidewall transversely spaced apart from the first spacer sidewall, the second wing for projection into, and extension along, the inwardly opening second groove;

each spacer also comprising a generally planar spacer member extending longitudinally and transversely between the lower edges of the first and second spacer sidewalls;

wherein, for each of the longitudinally extending spacers, a transverse cross-section of the spacer is substantially uniform over its longitudinal dimension and the spacer sidewalls extend past the respective wings into the channel and abut the upper groove members when the spacers are inserted into the channel for supporting the spacer sidewalls;

wherein the railing system comprises at least one post comprising an open-ended head, the open-ended head:

rigidly attached to an upper face of the post;

extending away from the post in a direction non-parallel to the post;

having first and second generally planar vertically and longitudinally extending head sidewalls, the first and second head sidewalls connected to a head upper member at transversely spaced apart locations;

having a uniform cross-sectional shape in its extension from the post to its opposing end, distal from the post, the uniform cross-sectional shape defined at least in part by the first and second generally planar vertically and longitudinally extending head sidewalls and the head upper member and the uniform cross-sectional shape shaped to substantially conform to longitudinally extending upper and side exterior surfaces of the handgrip portion;

shaped to receive the top rail; and shaped to support the first and second longitudinally extending sections of the handgrip portion;

wherein the lower groove member of the first groove has a first lower face that extends from the first face of the first sidewall along an entire inward extent of the lower groove member of the first groove and is co-planar with a lower edge of the first sidewall and the lower groove member of the second groove has a second lower face that extends from the second face of the second sidewall along an entire inward extent of the lower groove member of the second groove and is co-planar with a lower edge of the second sidewall.

2. The railing system according to claim 1 wherein once the first and second wings are inserted into the first and second grooves, the first wing is substantially constrained from upward or downward movement by the first and second groove members of the first groove and the second wing is substantially constrained from upward or downward movement by the first and second groove members of the second groove.

3. A railing system according to claim 2 wherein the first and second grooves are shaped to have rectangular cross-sections.

4. The railing system according to claim 1 wherein the first wing extends in the first outward direction from the first spacer sidewall along a first longitudinally extending location that is spaced upwardly from the lower edge of the first spacer sidewall and the second wing extends in the second outward direction from the second spacer sidewall along a second longitudinally extending location that is spaced apart from the lower edge of the second spacer sidewall.

5. The railing system according to claim 4 wherein the spacing between the first wing and the lower edge of the first spacer sidewall and the spacing between the second wing and the lower edge of the second spacer sidewall are dimensioned such that when the first and second wings are inserted into the first and second grooves, the first lower face of the first lower groove member, the second lower face of the second lower groove member and a lower face of the generally planar spacer member are co-planar with one another.

6. The railing system according to claim 1 wherein each spacer is shaped such that when the first and second wings are inserted into the first and second grooves, the first lower face of the first lower groove member, the second lower face of the second lower groove member and a lower face of the generally planar spacer member are co-planar with one another.

7. The railing system according to claim 1 wherein each spacer comprises a lower spacer face and wherein each spacer is shaped such that when the first and second wings are inserted into the first and second grooves, the first lower face of the first lower groove member, the second lower face of the second lower groove member and the lower spacer face are co-planar with one another.

8. A railing system according to claim 1 wherein the handgrip portion and the first elongated channel form an elongated bore extending longitudinally along the top rail.

9. A railing system according to claim 8 wherein the bore has an inverted U-shape in cross section.

10. A railing system according to claim 1 wherein the first and second sidewalls project downwardly past the first and second edges of the handgrip portion.

11. A railing system according to claim 10 wherein the first and second edges of the handgrip portion are joined to the first and second sidewalls at corresponding first and second locations spaced apart from vertical extremities of the first and second sidewalls.

12. A railing system according to claim 1 wherein the first elongated channel and handgrip portion are constituted by a unitary structure of aluminum.

13. A railing system according to claim 1 wherein a top of the first elongated channel is defined by a substantially planar member that extends between the first and second sidewalls and longitudinally therealong.

14. A railing system according to claim 13 wherein the first elongated channel defined by the first and second sidewalls and the substantially planar member is substantially square in cross section.

15. A railing system according to claim 1 comprising:

a bottom rail comprising a second elongated channel;

wherein the plurality of pickets each have lower ends dimensioned to be received in the second elongated channel; and the plurality of spacers are adapted for engagement in the first and second elongated channels, the spacers configured to space apart the upper and lower ends of adjacent pickets in the first and second channels.

16. The railing system according to claim 15 wherein the spacers are configured to lie substantially flush with lower edges of the first and second sidewalls when engaged in the first elongated channel.

17. A railing system according to claim 1 wherein the top rail and the spacers are fabricated from the same material.

18. A railing system according to claim 1 wherein the first lower face of the first lower groove member is co-extensive with the lower edge of the first sidewall and wherein the second lower face of the second lower groove member is co-extensive with the lower edge of the second sidewall.

* * * * *